US007846262B2

(12) United States Patent
Gray et al.

(10) Patent No.: US 7,846,262 B2
(45) Date of Patent: Dec. 7, 2010

(54) AQUEOUS CLEANING OF LIQUID RESIDUE BY ETCHING

(76) Inventors: Donald J. Gray, 9 McGraw Ct., Warwick, RI (US) 02818; Charlotte Frederick, 240 N. Sunway Dr., Tempe, AZ (US) 85284

( * ) Notice: Subject to any disclaimer, the term of this patent is extended or adjusted under 35 U.S.C. 154(b) by 0 days.

(21) Appl. No.: 11/936,872

(22) Filed: Nov. 8, 2007

(65) Prior Publication Data

US 2009/0120463 A1 May 14, 2009

(51) Int. Cl.
*B08B 3/04* (2006.01)
*B08B 3/08* (2006.01)
*B08B 3/10* (2006.01)

(52) U.S. Cl. ..... 134/21; 19/34; 19/35

(58) Field of Classification Search ..... 134/21, 134/34, 35

See application file for complete search history.

(56) References Cited

U.S. PATENT DOCUMENTS 4,193,818 A * 3/1980 Young et al. ..... 134/1
4,327,813 A * 5/1982 Manin ..... 181/120
4,565,583 A * 1/1986 Venetta ..... 134/12
4,817,652 A * 4/1989 Liu et al. ..... 134/102.1
5,268,036 A * 12/1993 Neubauer et al. ..... 134/2
6,418,942 B1 7/2002 Gray et al.
6,743,300 B2 6/2004 Gray
6,783,601 B2 8/2004 Gray et al.
6,783,602 B2 8/2004 Gray
6,802,137 B1 10/2004 Gray
6,824,620 B2 11/2004 Gray et al.
2002/0157686 A1 * 10/2002 Kenny et al. ..... 134/1.3

* cited by examiner

*Primary Examiner*—Michael Kornakov
*Assistant Examiner*—Natasha Campbell
(74) *Attorney, Agent, or Firm*—Barlow, Josephs & Holmes, Ltd.

(57) ABSTRACT

The present invention is a method of cleaning an object in an open aqueous cleaning system. The method is directed to an open cleaning vessel into which water used for cleaning a material or object can be introduced. A means is provided for introducing a reactant chemical to the vessel to form an aqueous solution. Cleaning of the surface is in the form of bubble formation on the part that vaporizes the chemical in order to react the oxidizer in the vapor state to the exposed surface at the bubble growth area. Treatment in the form of etching or any other process in which material is removed from a solid surface displaces the liquid residue from the surface. The resulting process produces no dissolution or emulsion of the contaminant and therefore can be easily separated from the chemical cleaner. The process also conserves chemistry, water, energy, and reduces pollution.

12 Claims, 4 Drawing Sheets

AQUEOUS CLEANING OF LIQUID RESIDUE BY ETCHING

BACKGROUND OF THE INVENTION

In today's manufacturing environment there is an ever growing need to meet more stringent environmental regulations, an ever increasing need to reduce water use, an increasing need to reduce energy use and an overall need to increase quality control and cut costs. Parts' cleaning is generally viewed as a simple process however quite often the lack of quality control in the parts' cleaning process often leads to rejected end products or rework. Cleaning solutions are becoming more sophisticated and thus more expensive. Chemical discharge to public facilities and chemical evaporation to the environment is becoming a major issue in most countries. Energy conservation has become a major cost cutting avenue.

The present invention focuses upon a reduction in up front chemical costs, minimizing water use, limited air pollution, increased quality control and reduced energy costs for most manufacturing parts' cleaning. The process often reduces the number of steps and process tanks required that could also lead to reduced capital costs.

The basic premise of the process is to chemically interact with the solid surface so as to reduce the physical wet ability of the residue fluid being removed. A fluid at its vapor pressure is vaporized at the solid surface either by heating the part or reducing the total pressure in the processing chamber.

A chemical, preferably an oxidizing agent, dissolved in the treating solution is vaporized and can rapidly diffuse to and oxidize the surface. The etching of the surface leads to a debonding of the fluid from the surface. The vapor being formed at the surface tends to lift the residue from the surface and transport the residue to the bulk liquid. The reacting chemical may also oxidize the liquid residue however the residue is not emulsified and rises to the surface to be physically removed from the vessel. The process fluid is essentially clean and can be recycled for reuse.

BRIEF SUMMARY OF THE INVENTION

The present invention is directed to a method of treating an object to remove residue in an open aqueous cleaning vessel. The vessel receives water used for cleaning a material or object. Means are provided for introducing a reactant chemical to the vessel to form an aqueous solution. Cleaning of the surface is in the form of bubble formation on the part that vaporizes the chemical in order to react the oxidizer in the vapor state to the exposed surface at the bubble growth area. Treatment in the form of etching or any other process in which material is removed from a solid surface displaces the liquid residue from the surface. Bubble growth and detachment provide for transport of the residue to the bulk liquid. Either transfer of heat from the preheated part or reducing the pressure in the vessel by continuously removing the vapor phase attains vaporization. Further steps recover residual contaminant from the vessel and may include recovering water from the object in order to dry the object.

A method of treating an object to remove residue in an open aqueous cleaning vessel, comprises the steps of:

(a) filling the cleaning vessel with water for cleaning;

(b) injecting a reactant chemical to the water to form an aqueous solution in the vessel;

(c) placing the object that may be preheated to be cleaned in the cleaning vessel;

(d) cleaning the object by allowing the liquid to heat or by pulling vacuum in the vessel to produce vapor bubbles at the surface of the object that reacts with the surface or the contaminant;

(e) recovering the contaminant from the cleaning vessel; and (f) removing the cleaned object from the cleaning vessel.

The above-noted method can be effectively used to remove liquid or solid residue from a solid surface. The effectiveness is site insensitive since a pressure reduction or heat transfer is uniform throughout the system and thus the pressure or heat inside channels and pores is equal to the surface conditions.

Another aspect of this invention is to clean parts without emulsifying or dissolving the liquid or solid residue thus allowing for waste-solution separation by floating, filtering or settling the contaminant.

Another aspect of this invention is to recycle the cleaning solution after separation of the contaminant so as to minimize water or chemical use.

Another aspect of this invention is to minimize energy use by recycling a heated cleaning solution minimizing the need to heat new makeup solution.

Another aspect of this invention is to use minimize cleaning chemical use by using small quantities of reactive chemicals as opposed to large quantities of surfactants or dissolution chemicals for cleaning.

Another aspect of this invention is to clean parts without using high energy consumption jets or ultrasonics for physical cleaning.

Another aspect of this invention is to clean parts without using air pollution chemicals such as often found in semi-aqueous and lipophilic solvents.

Another aspect of this invention is to rapidly dry parts by steam preheating followed by vacuum drying in order to shorten cycle time and prevent water spotting.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENTS

Figure 1:
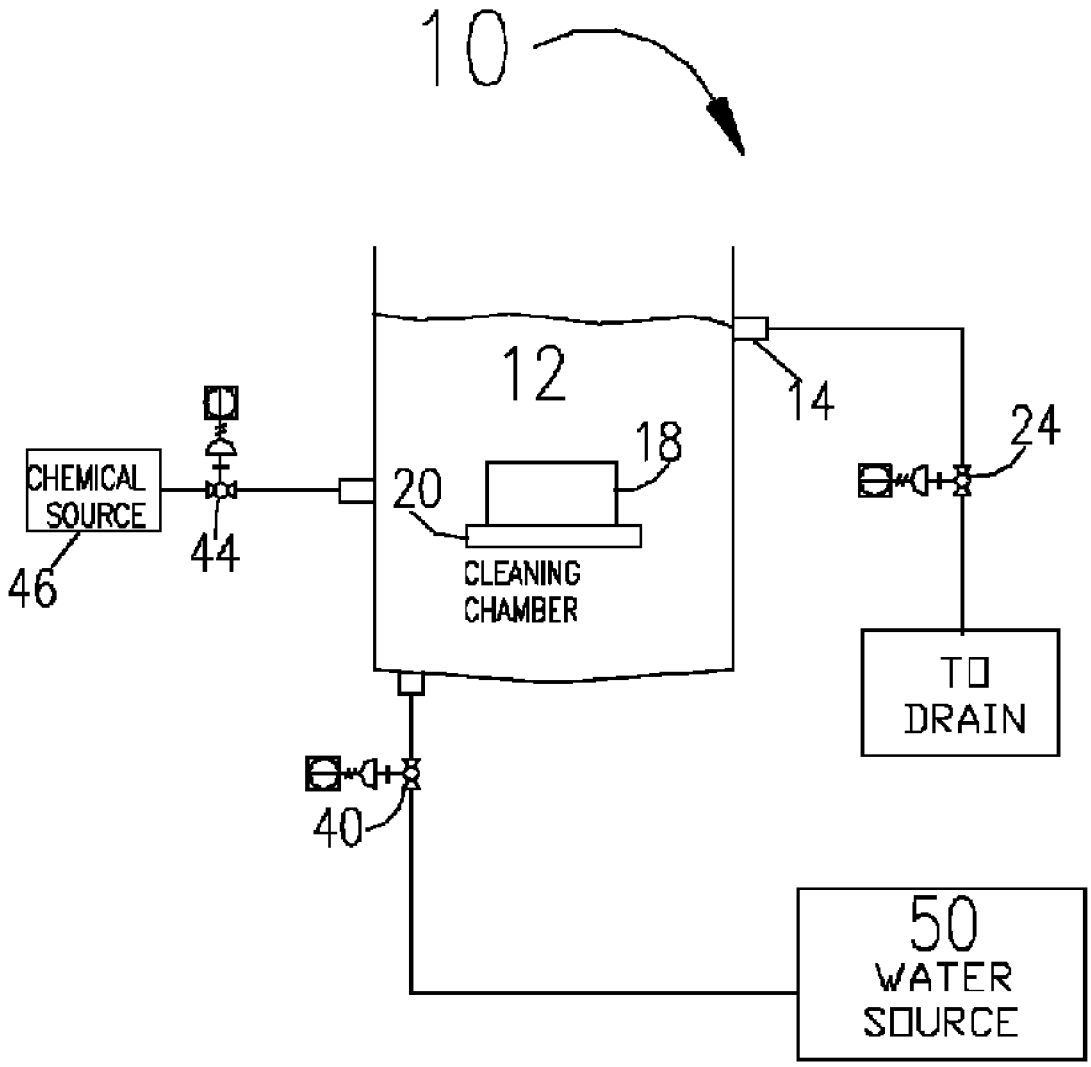
FIG. 1 is a schematic illustration of the open aqueous cleaning system as used in the method of the present invention.

Referring now to the drawings, the method of cleaning an object in an open aqueous cleaning system of the present invention is illustrated and generally indicated at 10 in FIG. 1. In FIG. 1, the open aqueous cleaning system 10 for implementing the teachings of this invention includes a main processing chamber generally indicated at 12 that may or may not be heated. Other component parts of the system 10 will be described in connection with operation thereof.

On startup, water is introduced into the cleaning vessel by opening valve 40 and filling the vessel from water source 50. After filling, valve 40 is closed and reactant chemical can be added to the water in the vessel from chemical source 46 by opening valve 44. After chemical addition, a preheated object 18 is placed in the vessel on an appropriate holder 20 to submerge the object in the solution. The temperature of the object is above the boiling point of the solution and vapor bubbles will begin to form and detach from the object subjecting the object to regions of vapor solid contact. The vapor coming in contact with the solid surface will contain a reactant chemical that can now diffuse easily to the surface and react either with the solid surface or the contaminant on the surface.

The reactant chemical may include acids such as acetic acid, sulfuric acid, nitric acid, citrus acid, hydrofluoric acid, boric acid, oxalic acid and phosphoric acid; amines such as ethanol amine, ethyl diamine and diethanol amine; ketones such as acetone and metyl ethyl ketone; hydoxides such as sodium, potassium, ammonium and calcium hydroxide; peroxides such as hydrogen and benzoyl peroxide and other chemicals such as ozone and N-methylpyrrolidone or any other chemical that chemically reacts with the surface or the contaminant.

Upon cleaning, water is again introduced to the vessel 12 by opening valve 40 and excess water exits the vessel through overflow port 14 carrying floating contaminant from the water surface to the drain.

Figure 2:
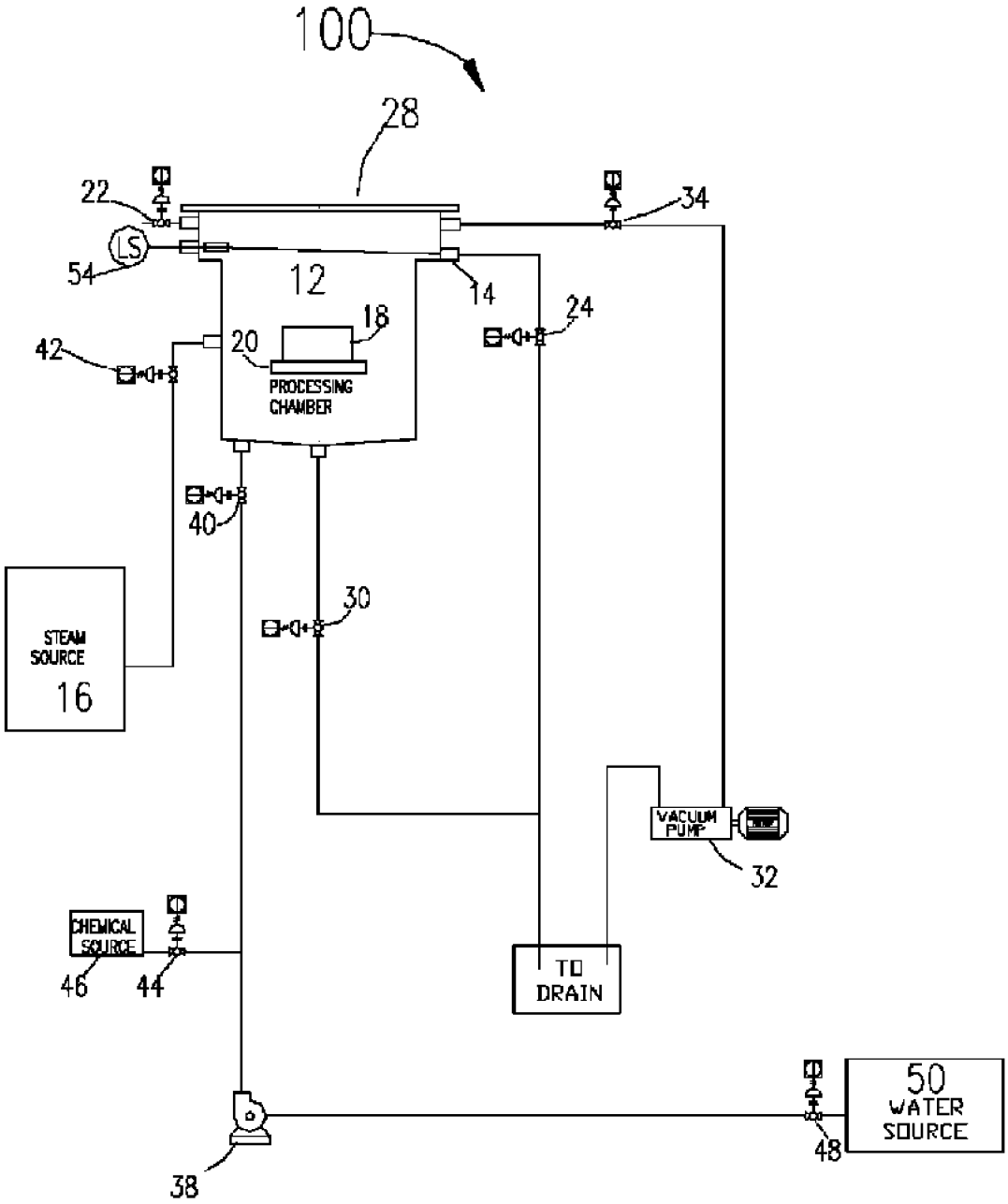
FIG. 2 is a schematic illustration of a preferred embodiment of the open aqueous cleaning system of FIG. 1.

Referring now FIG. 2, the open aqueous cleaning system of the present invention is illustrated and generally indicated at 100 in FIG. 2. The system 100 for implementing the teachings of this invention includes a main cleaning vessel generally indicated at 12 that may or may not be heated. The main chamber 12 includes a lid 28. Other component parts of the system 100 will be described in connection with operation thereof.

On startup of the process, the cleaning vessel 12 is charged with water from water source 50 through valve 40 and with chemical reactant from source 46 through valve 44. In the preferred embodiment the charged chemical is hydrogen peroxide. The solution in vessel 12 may or may not be heated.

On startup of cleaning, a part 18 to be treated can be placed in the chamber 12 on an appropriate holder 20. Closing lid 28 and vent valve 22 then seals the chamber 12. Vacuum pump 32 is then activated, valve 34 is opened, and the chamber 12 is evacuated of essentially all the air. Typically, a mechanical dry pump can evacuate the vessel to pressures equal to the solution's vapor pressure. Other pumps such as liquid ring pumps, pneumatic pumps, diaphragm pumps or constant displacement, or other conventional vacuum pumps can also be used.

Upon evacuating all the air, vacuum pump 32 now begins to remove evaporating water vapor from the vessel. Removal of the vapor reduces pressure within the system 100, and since the solvent in the chamber 12 is under vacuum, vapor bubbles will begin to nucleate at the solid surfaces including the surface of the part 18. If the vacuum pump 32 continues to evacuate vapors, the vapor bubbles at the surface will grow, detach from the solid surface and rise to the top of the vessel 12 to replenish the vapor being removed by the vacuum pump 32, thus maintaining the chamber at or around the vapor pressure of the solution. Such a condition will continually allow replenishment of the surface with fresh solution at the region where vapor bubbles are detached, i.e. the bubbles create a desired solution flow over the surface of the part 18. These regions will thus experience a rapid increase in vapor concentration at the solid surface.

In one embodiment, the vapor coming in contact with the solid surface will contain hydrogen peroxide or ozone that can diffuse rapidly to the surface and chemically react with the solid surface or contaminant. Other solutions including mineral acids, amines, hydroxides, ketones or any other chemical that can react with the object's surface or with the contaminant on the surface can be used in place of hydrogen peroxide. The reaction can be in the form of surface etching and carbon bond attack on the solid surface and contaminant respectively. Other surface reactions such as oxidation, anodic reactions, ion exchange and any other reaction that alters the surface chemistry can be used. Contaminant reactions could be saponification, hydrolysis, cracking and any other reaction that alters the contaminant chemistry.

The resulting reactions debond the liquid contaminant from the surface and the vapor bubbles detaching from the surface transports the contaminant to the bulk fluid. Because of the difference in fluid density and the continuous upward flow of vapor bubbles, the contaminant floats to the solution surface and accumulates with time. Heavier contaminants could also be removed and may either float to the surface attached to vapor bubbles or settle to the vessel bottom to be remove through a bottom port.

Upon completion of cleaning of object 18, valve 34 is closed and vacuum pump 32 is turned off. Valve 22 is opened to return chamber 12 to atmospheric pressure. Valve 40 is again opened and additional water from water source 50 is introduced to chamber 12. Excess water and floating contaminant now begins to enter overflow port 14 to be sent to the drain. Upon completing the contaminant skimming, valve 40 is closed. Lid 28 can now be opened and object 18 can be removed from cleaning vessel 12.

Figure 3:
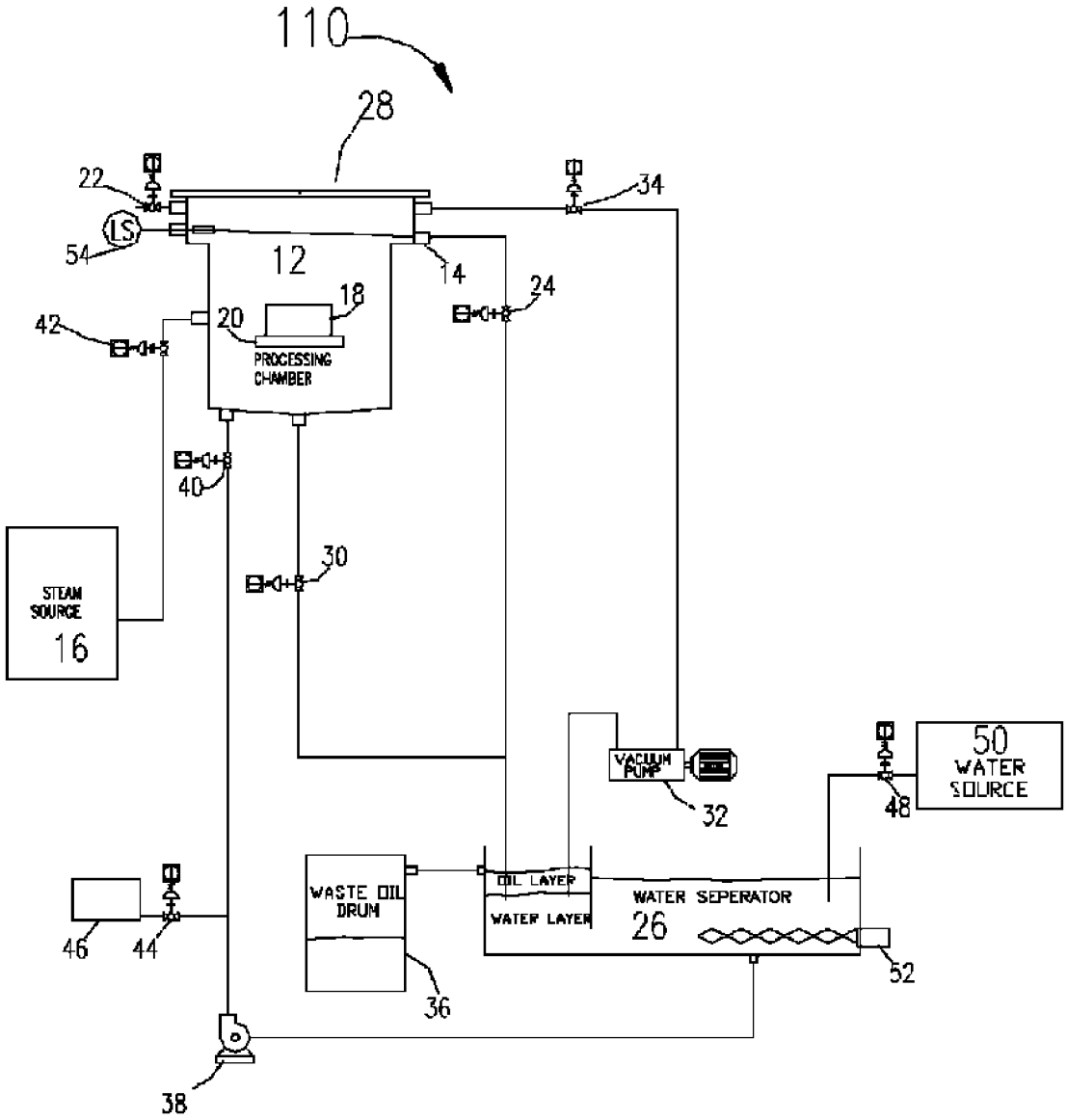
FIG. 3 is a schematic illustration of an alternative embodiment of the open aqueous cleaning system of FIG. 1.

Now referring to FIG. 3, a number of options are depicted that are easily adapted to the open aqueous cleaning system. For enhanced bubble formation, the object 18 can be preheated within vessel 12. In one embodiment, on startup, a part 18 to be cleaned can be placed in the vessel 12 on an appropriate holder 20. Closing lid 28 and vent valve 22 then seals the chamber 12. Vacuum pump 32 is then activated, valve 34 is opened, and the chamber 12 is evacuated of essentially all the air.

To initiate cleaning, valve 42 is opened and since the vessel is free of air, the steam from steam source 16 flashes into the processing chamber 12 and increases the pressure in chamber 12. Condensing steam heats the part 18, holder 20 and vessel 12 to a temperature above ambient temperature. Other types of heating such as light, radiation and non-condensable heated gas circulation can be used to preheat the object 18. Upon heating the part 18, valve 42 is closed and cleaning can proceed as described above in the preferred embodiment.

It may be desirable to conserve water use. To accomplish this tank 26 and pump 38 are added to the system in order to assist in recycling water as depicted in FIG. 3. After preheating the object 18, water is introduced to the cleaning vessel 12 by opening valve 40 and activating pump 38 to fill the vessel from water tank 26. Water tank 26 may be as shown with electric heater 52. Optionally, steam heaters or direct steam injection can be used. During filling, reactant chemical can be added to the incoming stream from chemical source 46 by opening valve 44. Optionally the chemical can be added to the cleaning vessel 12 directly as above or can be added to water tank 26 prior to filling vessel 12.

Upon completing the cleaning step, contaminant can now be recovered from the vessel 12 by opening valve 22 to return vessel 12 to atmospheric pressure. Valves 24 and 40 are opened and pump 38 is activated to introduce additional water to vessel 12 from tank 26. Excess fluid and floating contaminant now begins to enter overflow port 14 to be returned to a separation section in the tank 26. Floating contaminant overflows from tank 26 to waste oil tank 36 to be separated from water to be recycled. Upon completing the contaminant skimming, valves 24 and 40 are closed and pump 38 is turned off. Valve 30 is then opened and the processing solution is drained from the chamber 12 to tank 26. Upon draining, valve 30 is closed.

It may also be desirable to dry object 18 prior to removal from cleaning tank 12. To accomplish this valve 22 is closed and valve 34 is opened and vacuum pump 32 is turned on and chamber 12 is again reduced in pressure. Reducing pressure may suffice to vacuum dry object 18 however to enhance drying it may be desirable to preheat the object 18. Upon evacuating vessel 12, pump 32 is turned off and valve 34 is closed.

To enhance drying, valve 42 is opened and steam from steam source 16 flashes into the cleaning vessel 12 and increases the pressure in vessel 12. Condensing steam heats the object 18, holder 20 and vessel 12 to a temperature above ambient temperature. Upon heating the object 18, valve 42 is closed.

Valves 22 and 30 are now opened to drain excess steam condensate from chamber 12. Upon draining the condensate, valves 22 and 30 are closed and valve 34 is opened and vacuum pump 32 is turned on and chamber 12 is again reduced in pressure. The excess condensate on the chamber 12, part 18 and holder 20 flashes from the chamber and dries the chamber, object and holder. Valve 22 and lid 28 are now opened and object 18 is removed from vessel 12.

Figure 4:
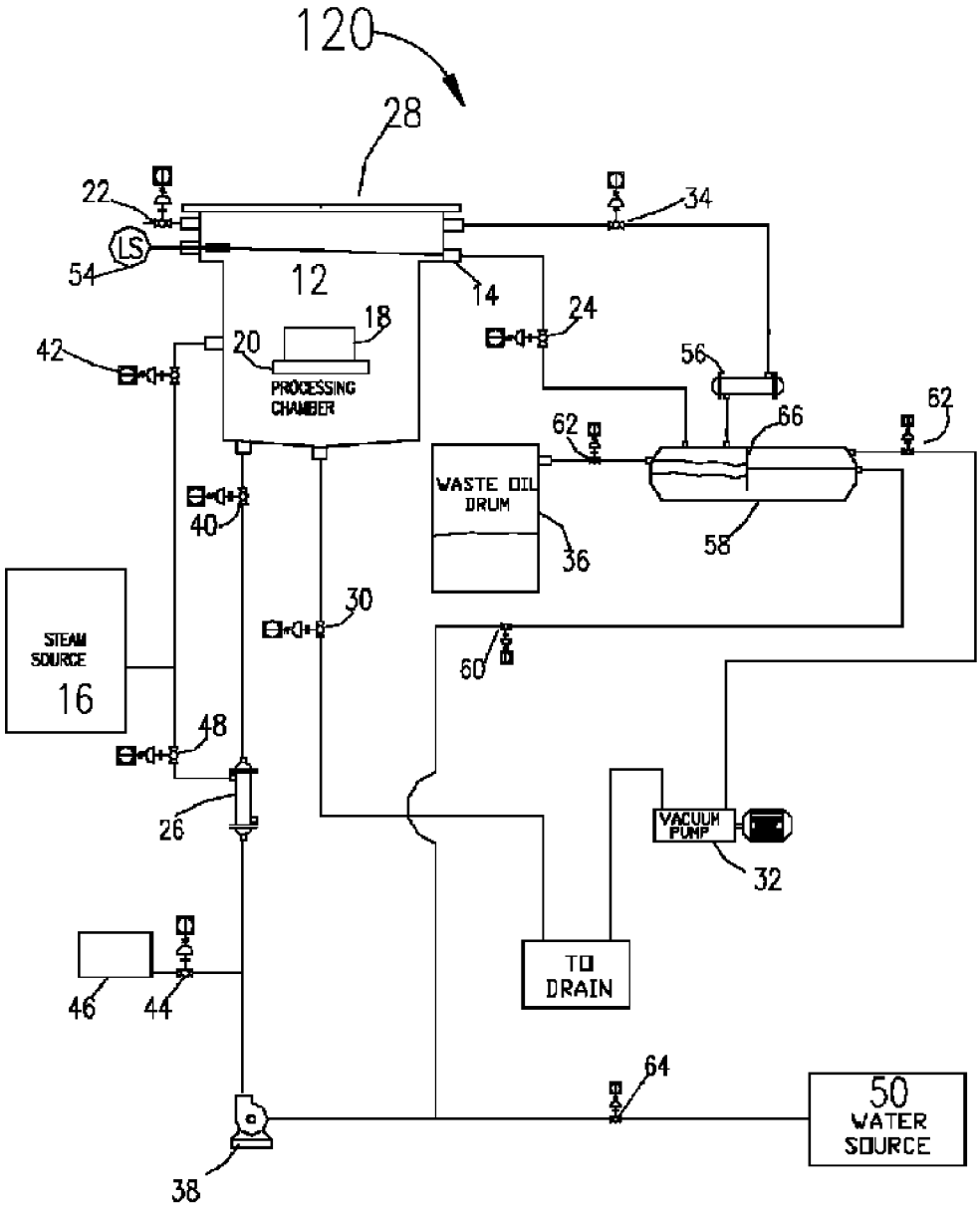
FIG. 4 is a schematic illustration of another alternative embodiment of the open aqueous cleaning system of FIG. 1.

Now referring to FIG. 4, a system 120 is shown for continuous removal of floating contaminant from the vessel 12. On startup after object 18 is placed in vessel 12 and lid 28 and valve 22 are closed, the cleaning vessel 12 is charged with water from water source 50 through valve 40 and with chemical reactant injected into the inlet stream from source 46 through valve 44. Opening valve 48 and heating the solution in heat exchanger 26 with steam from steam source 16 can preheat the aqueous solution formed. In one embodiment the charged chemical is hydrogen peroxide for moderate cleaning or ozone for more aggressive cleaning.

Following filling the vessel 12, enclosed water tank 58 and vessel 12 are both evacuated of air by opening valves 34 and 62 and activating vacuum pump 32. After evacuating all the air, vapor bubbles will begin to form and contaminant will be removed from the surface of object 18 and float to the top of vessel 18 as described above Contaminant can now be continuously removed from the vessel 12 through overflow port 14 by opening valves 24, 60 and 40 and activating circulation pump 38 to recirculate water to vessel 12 from water tank 58. Contaminant leaving port 14 can be separated in water tank 58 by using a water separation section 66. Floating contaminant is collected in the water tank 58 in the separation section during recirculation of water. Upon completion of cleaning object 18, Valves 34, 24, 62, and 40 are closed and pumps 32 and 38 are turned off. Water tank 58 and vessel 12 are brought back to atmospheric pressure by opening valves 22 and 34. Water is drained from vessel 12 by opening valve 30 and sent to drain or recovered and contaminant is drained to waste drum 36 by opening valve 62.

It can therefore be seen that the present invention provides a unique method for cleaning an object in an open aqueous cleaning system that conserves chemistry, water, and energy while reducing pollution.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A method of cleaning an object in an open aqueous cleaning system, said system including a cleaning chamber, said object having a solid surface with a contaminant residing on the solid surface, said method comprising the steps of:

introducing water into said cleaning vessel;

injecting a chemical reactant into said water;

preheating said object;

producing a stream of vapor bubbles to form at a surface of said object by disposing said preheated object in said cleaning chamber and pulling a vacuum on said chamber, said vapor bubbles cleaning said object by reacting said chemical with the said objects solid surface; and recovering the object from the cleaning chamber.

2. The method of claim 1 wherein said step of producing a stream of vapor bubbles to form at a surface of said object said vapor bubbles cleaning said object includes recovering the contaminant from the chamber using methods of skimming, settling, coagulating or filtering said contaminant.

3. The method of claim 1 wherein said step of recovering the object from within the cleaning chamber includes preheating the object with steam and applying a vacuum to the cleaning chamber to dry said object.

4. The method of claim 1 wherein the said chemical's reaction includes a reaction with the said residue on the solid surface.

5. The method of claim 1 wherein the said chemical reacts with the solid surface while in the vapor state.

6. The method of claim 1 wherein the said chemical reacts with the solid surface while in the liquid state.

7. A method of cleaning an object in an open aqueous cleaning system, said system including a cleaning chamber, said object being disposed in said cleaning chamber, said object having a solid surface with a contaminant residing on the solid surface, said method comprising the steps of:

introducing water into said cleaning vessel;

injecting a chemical reactant into said water;

producing a stream of vapor bubbles to form at a surface of said object by heating the object and pulling a vacuum on said chamber; and recovering the object from the cleaning chamber.

8. The method of claim 7 wherein said step of heating the object and pulling a vacuum on said chamber to produce a stream of vapor bubbles to form at a surface of said object includes preheating the water and chemical reactant.

9. The method of claim 7 wherein said step of heating the object and pulling a vacuum on said chamber to produce a stream of vapor bubbles to form at a surface of said object includes operating the process in an enclosed vessel at pressures above atmospheric pressure and forming vapor bubbles when this pressure is released.

10. The method of claim 7 wherein said step of heating the object and pulling a vacuum on said chamber to produce a stream of vapor bubbles to form at a surface of said object includes injecting steam into the liquid in the chamber to heat the object during processing.

11. The method of claim 7 wherein heating the object and pulling a vacuum on said chamber to produce a stream of vapor bubbles to form at a surface of said object includes heating the said cleaning chamber during processing.

12. A method of cleaning an object in an open aqueous cleaning system, said system including a cleaning chamber, said object having a solid surface with a contaminant residing on the solid surface, said method comprising the steps of:

introducing an aqueous solution into said cleaning vessel;

producing a stream of vapor bubbles to form at a surface of said object by heating the object and pulling a vacuum on said chamber; and recovering the object from the cleaning chamber.

* * * * *